US011095028B2

(12) United States Patent
Ting et al.

(10) Patent No.: US 11,095,028 B2
(45) Date of Patent: Aug. 17, 2021

(54) FREQUENCY TUNABLE ANTENNA AND METHOD OF MANUFACTURING THE SAME, DISPLAY PANEL

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Tienlun Ting, Beijing (CN); Guangkui Qin, Beijing (CN); Lei Wang, Beijing (CN); Ken Wen, Beijing (CN); Xiangzhong Kong, Beijing (CN)

(73) Assignees: BEIJING BOE OPTOELECTRONICS TECHNOLOGY CO., LTD, Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 90 days.

(21) Appl. No.: 16/402,862

(22) Filed: May 3, 2019

(65) Prior Publication Data

US 2019/0363434 A1 Nov. 28, 2019

(30) Foreign Application Priority Data

May 28, 2018 (CN) ..... 201810521505.0

(51) Int. Cl.
*H01Q 1/50* (2006.01)
*H01P 3/00* (2006.01)
(Continued)

(52) U.S. Cl.
CPC ..... *H01Q 1/50* (2013.01); *H01P 3/003* (2013.01); *H01Q 1/22* (2013.01); *H01Q 7/00* (2013.01); *H01Q 9/16* (2013.01)

(58) Field of Classification Search
CPC .. H01Q 1/50; H01Q 1/22; H01Q 7/00; H01Q 9/16; H01Q 7/005; H01Q 9/285;
(Continued)

(56) References Cited

U.S. PATENT DOCUMENTS 4,518,965 A 5/1985 Hidaka
10,128,571 B2 * 11/2018 Sazegar ..... H01P 7/088
(Continued)

FOREIGN PATENT DOCUMENTS

CN 105094231 A 11/2015
CN 105308789 A 2/2016
(Continued)

OTHER PUBLICATIONS

Frequency adjustable antenna and manufacturing, Publication No. CN 105552535A and Application No. CN 201610096052A (Year: 2016).*
(Continued)

*Primary Examiner* — Minh D A
(74) *Attorney, Agent, or Firm* — McDermott Will and Emery LLP

(57) ABSTRACT

A frequency tunable antenna includes a first substrate and a second substrate that are disposed opposite to each other, a second electrode disposed on a side of the second substrate close to the first substrate, a first electrode disposed on a side of the first substrate close to the second substrate, and a liquid crystal layer disposed between the second electrode and the first electrode. The second electrode and the first electrode are configured to adjust transmitting and receiving frequencies of the frequency tunable antenna by controlling an alignment manner of liquid crystals of the liquid crystal layer.

9 Claims, 7 Drawing Sheets

(51) Int. Cl.

| | |
|---|---|
| ***H01Q 1/22*** | (2006.01) |
| ***H01Q 7/00*** | (2006.01) |
| ***H01Q 9/16*** | (2006.01) |

(58) Field of Classification Search

CPC .... H01Q 9/0442; H01Q 9/0457; H01Q 1/364; H01Q 1/48; H01Q 5/321; H01P 3/003

See application file for complete search history.

(56) References Cited

U.S. PATENT DOCUMENTS

| | | | | |
|---|---|---|---|---|
| 10,141,620 | B2 * | 11/2018 | Jakoby | H01P 1/184 |
| 2007/0290934 | A1 | 12/2007 | Nakamura et al. | |
| 2016/0241217 | A1 | 8/2016 | Sazegar et al. | |
| 2017/0179567 | A1 | 6/2017 | Zou et al. | |
| 2017/0279194 | A1 | 9/2017 | Black et al. | |
| 2017/0338569 | A1 * | 11/2017 | Hower | H01Q 21/064 |
| 2018/0138594 | A1 * | 5/2018 | Orui | H01Q 3/34 |
| 2019/0103644 | A1 | 4/2019 | Jakoby et al. | |
| 2019/0103671 | A1 | 4/2019 | Dong et al. | |

FOREIGN PATENT DOCUMENTS

| | | | |
|---|---|---|---|
| CN | 105552535 | A | 5/2016 |
| CN | 106684551 | A | 5/2017 |
| CN | 107565195 | A | 1/2018 |
| CN | 107706502 | A | 2/2018 |
| JP | 3815613 | B2 | 8/2006 |

OTHER PUBLICATIONS

First Office Action issued in corresponding Chinese Application No. 201810521505.0, dated Sep. 23, 2019, with English translation.

Second Office Action issued in corresponding Chinese Application No. 201810521505.0, dated Jun. 1, 2020 with English translation.

* cited by examiner

FREQUENCY TUNABLE ANTENNA AND METHOD OF MANUFACTURING THE SAME, DISPLAY PANEL

CROSS-REFERENCE TO RELATED APPLICATION

This application claims priority to Chinese Patent Application No. 201810521505.0, filed on May 28, 2018, titled "A FREQUENCY TUNABLE ANTENNA AND METHOD OF MANUFACTURING THE SAME", which is incorporated herein by reference in its entirety.

TECHNICAL FIELD

The present disclosure relates to the field of glass substrate antenna manufacturing, and in particular, to a frequency tunable antenna and a method of manufacturing the same, and a display panel.

BACKGROUND

A properly functioning antenna can generally be considered as an inductor whose inductance value varies as a wavelength of an electromagnetic wave received or emitted by the antenna changes.

SUMMARY

In an aspect, a frequency tunable antenna is provided, which includes a first substrate and a second substrate that are opposite to each other, a second electrode disposed on a side of the second substrate close to the first substrate, a first electrode disposed on a side of the first substrate close to the second substrate, and a liquid crystal layer disposed between the second electrode and the first electrode. The second electrode and the first electrode are configured to adjust transmitting and receiving frequencies of the frequency tunable antenna by controlling an alignment manner of liquid crystals of the liquid crystal layer.

Optionally, at least a portion of the liquid crystal layer is disposed between the first electrode and a feeding portion of the second electrode.

Optionally, an orthographic projection of at least a portion of the liquid crystal layer on the first substrate, an orthographic projection of at least a portion of the feeding portion of the second electrode on the first substrate, and an orthographic projection of at least a portion of the first electrode on the first substrate completely overlap with each other.

Optionally, at least a portion of the liquid crystal layer is disposed between the first electrode and an intermediate section of a coil portion of the second electrode. The intermediate section of the coil portion is a section of the coil portion located in a preset range at both sides of a midpoint of the coil portion, wherein the midpoint is a point at half a length of the coil portion.

Optionally, the second electrode is a microstrip.

Optionally, the second electrode is a coplanar waveguide electrode.

Optionally, the first electrode is a ground electrode.

Optionally, the frequency tunable antenna is selected from a group consisting of a coil antenna, a slot coupled patch antenna, a coplanar waveguide feeding coil antenna, and a coplanar waveguide feeding dipole antenna.

Optionally, the frequency tunable antenna is a coplanar waveguide feeding coil antenna. An orthographic projection of at least a portion of the first electrode on the second substrate, an orthographic projection of at least a portion of the intermediate section of the coil portion on the second substrate, and an orthographic projection of at least a portion of the liquid crystal layer on the second substrate completely overlap with each other.

Optionally, the frequency tunable antenna is a coil antenna. The second electrode includes a coil electrode wound in a preset direction, and the first electrode is a ground electrode. At least a portion of the liquid crystal layer is disposed between a feeding portion of the coil electrode and the ground electrode.

Optionally, the frequency tunable antenna is a slot coupled patch antenna, and the first electrode is a ground electrode. The slot coupled patch antenna further includes a patch electrode disposed on a side of the first substrate away from the second substrate. The ground electrode includes a coupling slot, and an orthographic projection of the coupling slot on the second substrate is located within an orthographic projection of the patch electrode on the second substrate. A portion of the microstrip is a feeding portion, and at least a portion of the liquid crystal layer is disposed between the ground electrode and the feeding portion of the microstrip. An orthographic projection of at least a portion of the feeding portion of the microstrip on the second substrate, an orthographic projection of at least a portion of the liquid crystal layer on the second substrate, and an orthographic projection of at least a portion of the ground electrode on the second substrate completely overlap with each other. The orthographic projection of the coupling slot on the second substrate and the orthographic projection of the liquid crystal layer on the second substrate do not overlap.

Optionally, the frequency tunable antenna is a coplanar waveguide feeding coil antenna. The coplanar waveguide electrode includes a feeding portion and a coil portion. The feeding portion includes a linear feeding portion, a first ground electrode, and a second ground electrode. One end of the coil portion is coupled to the linear feeding portion, and another end of the coil portion is coupled to the first ground electrode. The first ground electrode and the second ground electrode are respectively disposed on both sides of the linear feeding portion. At least a portion of the liquid crystal layer is disposed between the linear feeding portion and the first electrode, between the first ground electrode and the first electrode, and between the second ground electrode and the first electrode.

Optionally, the frequency tunable antenna is a coplanar waveguide feeding dipole antenna. The coplanar waveguide electrode includes a first sub-antenna electrode, a second sub-antenna electrode, a sub-feeding portion coupled to the second sub-antenna electrode, a first ground electrode, and a second ground electrode. A feeding portion of the coplanar waveguide electrode includes the sub-feeding portion, the first ground electrode, and the second ground electrode. The first sub-antenna electrode is coupled to the first ground electrode, and the first ground electrode and the second ground electrode are respectively disposed on both sides of the sub-feeding portion. At least a portion of the liquid crystal layer is disposed between the first ground electrode and the first electrode, between the second ground electrode and the first electrode, and between the feeding portion of the sub-feeding portion and the first electrode.

Optionally, a frequency of a voltage across the second electrode and the first electrode is within a preset range of (0, 1000) Hz.

In another aspect, a display panel is provided, which includes the frequency tunable antenna described above.

In yet another aspect, a method of manufacturing a frequency tunable antenna is provided, which includes: forming a first electrode on a side of the first substrate; forming a second electrode on a side of the second substrate; assembling the first substrate and the second substrate with the side of the first substrate formed with the first electrode and the side of the second substrate formed with the second electrode opposite to each other; and forming a liquid crystal layer between the second electrode and the first electrode. The second electrode and the first electrode are configured to adjust transmitting and receiving frequencies of the frequency tunable antenna by controlling an alignment manner of liquid crystals of the liquid crystal layer.

BRIEF DESCRIPTION OF THE DRAWINGS

In order to describe technical solutions in embodiments of the present disclosure more clearly, the accompanying drawings to be used in the description of disclosure will be introduced briefly. Obviously, the accompanying drawings to be described below are merely some embodiments of the present disclosure, and a person of ordinary skill in the art can obtain other drawings according to these drawings without paying any creative effort.

DETAILED DESCRIPTION

Figure 1:
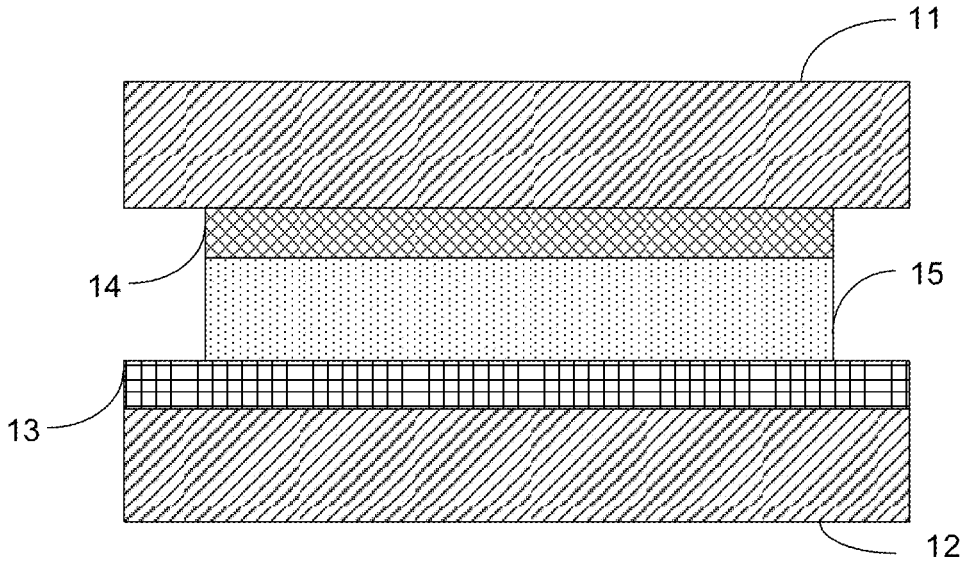
FIG. 1 is a schematic diagram showing a structure of a frequency tunable antenna, in accordance with some embodiments.

The technical solutions in embodiments of the present disclosure will be described clearly and completely below with reference to the accompanying drawings in the embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

It will be noted that, in embodiments of the present disclosure, words like "exemplary" or "for example" are used to indicate an example, an illustration, or a description. Any embodiment or design described as "exemplary" or "for example" in embodiments of the present disclosure should not be construed as preferred or advantageous over other embodiments or designs. Rather, use of the words "exemplary" or "for example" is intended to present relevant concepts in an exemplary manner.

It will also be noted that, in embodiments of the present disclosure, "of", "corresponding" and "relevant" may sometimes be used as appropriate. It will be noted that meanings expressed by these words are consistent when a distinction is not emphasized.

In order to facilitate description of technical solutions of embodiments of the present disclosure, in embodiments of the present disclosure, words such as "first" and "second" are used to distinguish between same or similar items whose functions and effects are substantially the same. Those skilled in the art will understand that the words such as "first" and "second" are not intended to limit a quantity and order of execution of the items.

In order to transmit and receive signals smoothly, a capacitor is added at a feed point of the antenna, so as to use a capacitive reactance of the capacitor to offset a change in the inductance of the antenna caused by a change in wavelength of the electromagnetic wave. That is, a reactance component of an input impedance of the antenna is offset by the capacitive reactance of the capacitor, so that the input impedance of the antenna is close to a characteristic impedance of the feed line. "Input impedance" refers to a ratio of a voltage to a current at the feed point of the antenna. Since the wavelength of the electromagnetic wave is inversely related to a frequency thereof, when the wavelengths of the electromagnetic waves change, transmitting and receiving frequencies of the antenna (i.e., frequencies of transmitting and receiving electromagnetic waves) also change, and a capacitance value of the capacitor also needs to be adjusted. Thus, in order to match the input impedance of the antenna to the characteristic impedance of the feed line, it is necessary to additionally provide a variable capacitor with a variable capacitance value at the feed point of the antenna, such that the input impedance of the antenna changes smoothly as the frequency of the electromagnetic wave changes.

Referring to FIG. 1, some embodiments of the present disclosure provide a frequency tunable antenna, which includes a first substrate 11 and a second substrate 12 that are opposite to each other, a first electrode 14, a second electrode 13, and a liquid crystal layer 15. The second electrode 13 is disposed on a side of the second substrate 12 close to the first substrate 11. The first electrode 14 is disposed on a side of the first substrate 11 close to the second substrate 12. The liquid crystal layer 15 is disposed between the second electrode 13 and the first electrode 14.

In response to the first electrode 14 and the second electrode 13 receiving a liquid crystal control voltage, the second electrode 13 and the first electrode 14 will control the alignment manner of liquid crystals of the liquid crystal layer 15 to cause liquid crystal director deformation, thereby changing a dielectric constant of the entire liquid crystal layer. Thus, a capacitance value of a capacitor formed by the second electrode 13, the first electrode 14, and the liquid crystal layer 15 disposed between the second electrode 13 and the first electrode 14 changes as the dielectric constant of the liquid crystal layer changes, thereby adjusting the transmitting and receiving frequencies of the frequency tunable antenna. As such, the frequency tunable antenna may be manufactured using an existing thin film transistor liquid crystal display (TFT-LCD) process (e.g., a photolithography process and a liquid crystal layer) and is compatible with the existing TFT-LCD process. Therefore, the use of additional devices (e.g., a welding device for welding a fabricated capacitor on a glass substrate) is avoided, and production cost is reduced. For example, the first electrode and the second electrode may be independently routed to receive the liquid crystal control voltage, so as to better control the alignment of the liquid crystals.

In some embodiments, both the first substrate 11 and the second substrate 12 are made of glass. For examples, two glass substrates included in the frequency tunable antenna are manufactured using glass substrates of a TFT-LCD, so that the frequency tunable antenna is more compatible with the process for manufacturing the TFT-LCD and the production cost is further reduced.

In order to change the transmitting and receiving frequencies of the antenna, in some embodiments, at least a portion of the liquid crystal layer 15 is disposed between the first electrode 14 and a feeding portion of the second electrode 13.

As shown in FIGS. 2A, 2B, 3A, 3B, 5A, 5B, 6A and 6B, the at least a portion of the liquid crystal layer is disposed between the first electrode and the feeding portion of the second electrode, and the frequency tunable antenna is at least, for example, selected from a group consisting of a coil antenna, a slot coupled patch antenna, a coplanar waveguide (CPW) feeding coil antenna, and a coplanar waveguide feeding dipole antenna. Of couse, the frequency tunable antenna may be other types of antenna.

Figure 4A:
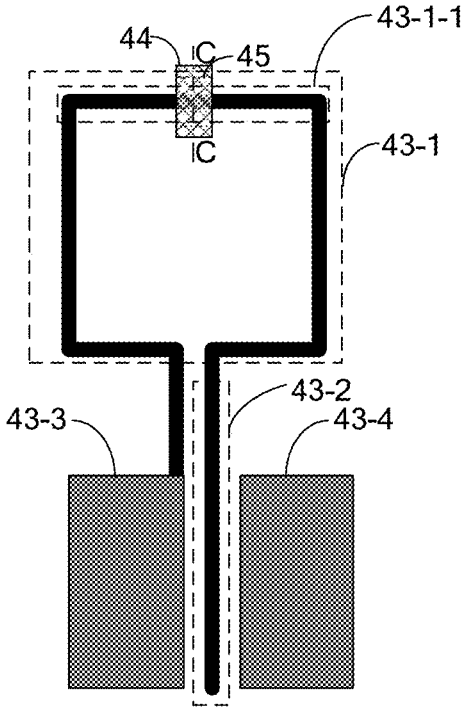
FIGS. 4A and 4B are schematic diagrams showing a structure of a coplanar waveguide feeding coil antenna, in accordance with some embodiments.
Figure 4B:
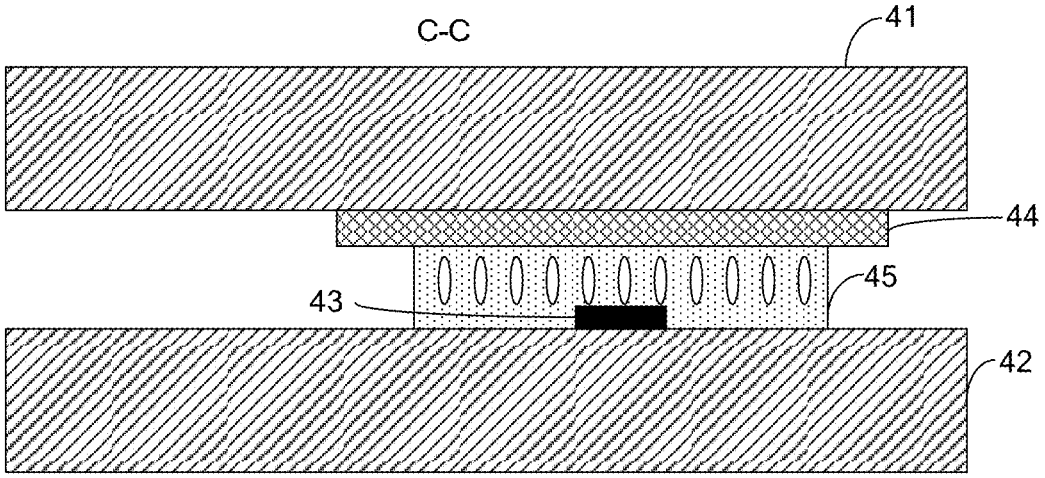

As shown in FIGS. 4A and 4B, except for providing a variable capacitor at the feeding portion of the antenna, for some coil antennas (e.g., a coplanar waveguide feeding coil antenna), the purpose of changing the transmitting and receiving frequencies of the antenna may also be achieved by providing a variable capacitor at an intermediate section of a coil portion of the second electrode (e.g., a preset range at both sides of a midpoint of the coil portion, wherein the midpoint is a point at half a length of the coil portion). Therefore, in some other embodiments, at least a portion of the liquid crystal layer is disposed between the first electrode and the intermediate section of the coil portion of the second electrode. The intermediate section of the coil portion is a section of the coil portion located in a preset range at both sides of a midpoint of the coil portion, wherein the midpoint is a point at half a length of the coil portion.

Control electrodes of the liquid crystals generally include two electrodes, at least one of which is a portion of the antenna itself. For example, a portion of the antenna itself is used as the second electrode. The portion of the antenna used as the second electrode refers to an antenna body electrode mainly responsible for transmitting and receiving signals. For example, the second electrode is a microstrip of the frequency tunable antenna. Optionally, the frequency adjustable antenna is a coplanar waveguide feeding type antenna, and the second electrode is a coplanar waveguide electrode.

In a case where a portion of the antenna itself is selected as one of the electrodes (e.g., the second electrode) for controlling the liquid crystals, another electrode (i.e., the first electrode) for controlling the liquid crystals may be an electrode included in the antenna itself, or may be an additional electrode. Optionally, the first electrode is a ground electrode. Optionally, the frequency tunable antenna is a coplanar waveguide feeding type antenna, and the first electrode is a separately provided electrode that is always powered during operation of the antenna to control the liquid crystals.

In some embodiments, a frequency of a voltage across the second electrode and the first electrode is within a preset range of (0,1000) Hz. A voltage in this range is able to control the liquid crystals without affecting the operation of the antenna.

The technical solutions of embodiments of the present disclosure will be described in detail below with reference to FIGS. 2A to 6B.

Figure 2A:
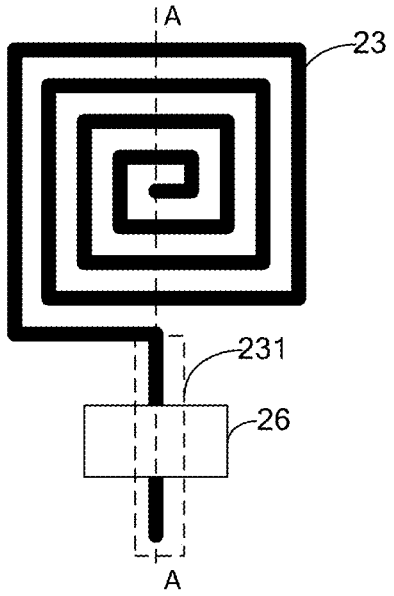
FIGS. 2A and 2B are schematic diagrams showing a structure of a coil antenna, in accordance with some embodiments.
Figure 2B:
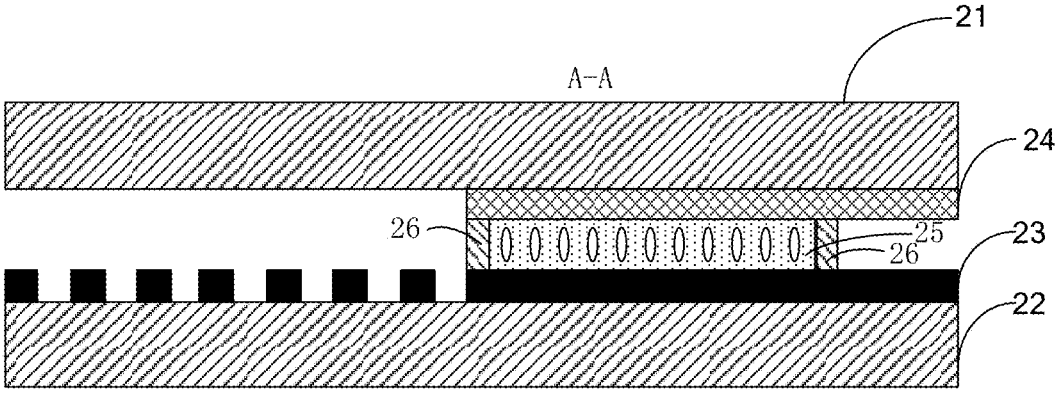

In some embodiments, the frequency tunable antenna is a frequency tunable antenna in the form of a coil antenna, as shown in FIGS. 2A and 2B. FIG. 2A is a top view of the frequency tunable coil antenna, and FIG. 2B is an enlarged cross-sectional view taken along line A-A in FIG. 2A. The frequency tunable coil antenna includes a first substrate 21, a second substrate 22, a first electrode 24, a second electrode 23, and a liquid crystal layer 25. For example, the first electrode 24 is a ground electrode 24, and the second electrode 23 is a coil electrode 23 wound in a preset direction, such as a microstrip.

The first substrate 21 and the second substrate 22 are disposed opposite to each other. The coil electrode 23 is disposed on a side of the second substrate 22 close to the first substrate 21. The ground electrode 24 is disposed on a side of the first substrate 21 close to the second substrate 22.

At least a portion of the liquid crystal layer 25 is disposed between a feeding portion 231 of the coil electrode 23 and the ground electrode 24. An orthographic projection of at least a portion of the liquid crystal layer 25 on the first substrate 21, an orthographic projection of at least a portion of the feeding portion 231 of the coil electrode 23 on the first substrate 21, and an orthographic projection of at least a portion of the ground electrode 24 on the first substrate 21 completely overlap with each other.

For example, referring to FIG. 2A, the coil electrode 23 is a microstrip wound in a counterclockwise direction, and the feeding portion 231 of the microstrip is strip-shaped.

In addition, the frequency tunable antenna further includes an outer package 26, and the outer package 26 is used for packaging the liquid crystals after the liquid crystal layer 25 is placed between the feeding portion 231 of the coil electrode 23 and the ground electrode 24, so as to ensure more stable performance of the liquid crystal layer. For example, the outer package 26 is a sealant that encapsulates the liquid crystals.

In some embodiments, since a width of the coil electrode and a width of the ground electrode are both small, the liquid crystal layer will be disposed not only in a space between the feeding portion of the coil electrode and the ground electrode. Instead, the liquid crystal layer will fill up a space exceeding the space between the coil electrode and the ground electrode. In some examples, as shown in FIG. 2B, in a top view, a shape of an outer contour of the liquid crystal layer is similar to a shape of an outer package 26, and a size of the outer contour of the liquid crystal layer may be slightly smaller than or equal to a size of an inner contour of the outer package 26.

In the coil antenna, the at least a portion of the liquid crystal layer 25 is disposed between the feeding portion 23 of the coil electrode 23 and the ground electrode 24 to realize the function of a variable capacitor. Moreover, the first electrode is an existing ground electrode, and the second electrode is an existing microstrip. Since both the first electrode and the second electrode are existing electrodes of the antenna, a manufacturing process is further simplified and the production cost is further reduced.

Figure 3A:
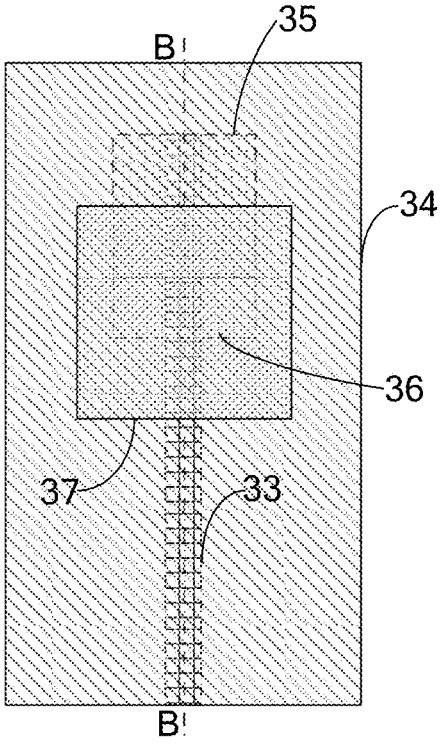
FIGS. 3A and 3B are schematic diagrams showing a structure of a slot coupled patch antenna, in accordance with some embodiments.
Figure 3B:
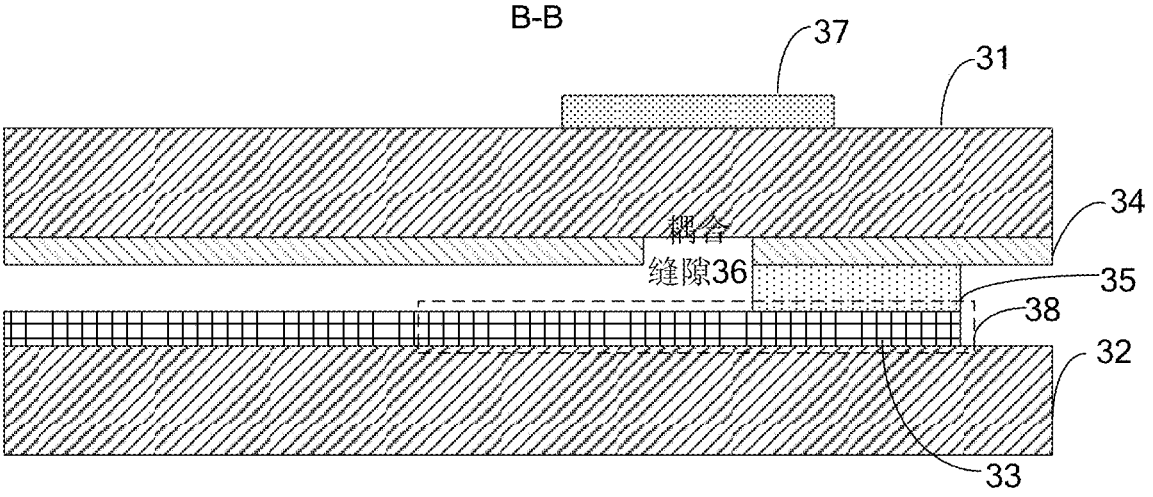

In some embodiments, the frequency tunable antenna is a frequency tunable antenna in the form of a slot coupled patch antenna, as shown in FIGS. 3A and 3B. FIG. 3A is a top view of the slot coupled patch antenna, and FIG. 3B is an enlarged cross-sectional view taken along line B-B in FIG. 3A. The slot coupled patch antenna includes a first substrate 31, a second substrate 32, a first electrode 34, a second electrode 33, and a liquid crystal layer 35. For example, the first electrode 34 is a ground electrode 34, and the second electrode 33 is a microstrip 33.

The first substrate 31 and the second substrate 32 are disposed opposite to each other. The microstrip 33 is disposed on a side of the second substrate 32 close to the first substrate 31. The ground electrode 34 is disposed on a side of the first substrate 31 close to the second substrate 32.

The slot coupled patch antenna further includes a patch electrode 37 disposed on a side of the first substrate 31 away from the second substrate 32. The ground electrode 34 includes a coupling slot 36, and an orthographic projection of the coupling slot 36 on the second substrate 32 is located within an orthographic projection of the patch electrode 37 on the second substrate 32.

In the slot coupled patch antenna, as shown in FIG. 3B, a portion of the microstrip 33 is the feeding portion 38, and the coupling slot 36 is close to and opposite to the feeding portion 38 of the microstrip 33. At least a portion of the liquid crystal layer 35 is disposed between the ground electrode 34 and the feeding portion 38 of the microstrip 33. An orthographic projection of at least a portion of the feeding portion 38 of the microstrip 33 on the second substrate 32, an orthographic projection of at least a portion of the liquid crystal layer 35 on the second substrate 32, and an orthographic projection of at least a portion of the ground electrode 34 on the second substrate 32 completely overlap with each other. An orthographic projection of the coupling slot 36 on the second substrate 32 and an orthographic projection of the liquid crystal layer 35 on the second substrate 32 do not overlap. An arrangement manner of the liquid crystal layer 35 in FIG. 3B is only an example.

For example, referring to FIG. 3A, the patch electrode 37 is a rectangular metal patch, the ground electrode 34 is a rectangular electrode plate having a coupling slot (e.g., a through hole), and the microstrip 33 is a strip-shaped microstrip.

In some embodiments, referring to FIG. 3A, the liquid crystal layer is not only disposed in a space between the feeding portion 38 of the microstrip 33 and the ground electrode 34. For example, the liquid crystal layer 35 extends beyond an end of the microstrip 33 and be disposed between the ground electrode 34 and the second substrate 32. That is, the liquid crystal layer is in contact with a surface of the second substrate 32 that is opposite to the ground electrode 34, and the liquid crystal layer is in contact with the ground electrode 34.

In the slot coupled patch, at least a portion of the liquid crystal layer is provided between a portion of the ground electrode close to the coupling slot and the microstrip to realize the function of a variable capacitor. Moreover, the first electrode is an existing ground electrode, and the second electrode is an existing microstrip. Since both the first electrode and the second electrode are existing electrodes of the antenna, the manufacturing process is further simplified and the production cost is further reduced.

In some embodiments, the frequency tunable antenna is a frequency tunable antenna in the form of a coplanar waveguide feeding coil antenna, as shown in FIGS. 4A and 4B. FIG. 4A is a top view of the coplanar waveguide feeding coil antenna, and FIG. 4B is an enlarged cross-sectional view taken along line C-C in FIG. 4A. The coplanar waveguide feeding coil antenna includes a first substrate 41, a second substrate 42, a first electrode 44, a second electrode 43, and a liquid crystal layer 45. For example, the second electrode 43 is a coplanar waveguide electrode 43.

The first substrate 41 and the second substrate 42 are disposed opposite to each other. The coplanar waveguide electrode 43 is disposed on a side of the second substrate 42 close to the first substrate 41. The first electrode 44 is disposed on a side of the first substrate 41 close to the second substrate 42.

The coplanar waveguide electrode 43 includes a feeding portion and a coil portion 43-1. In the coplanar waveguide feeding coil antenna, the purpose of adjusting the frequency of the antenna may also be achieved by providing a variable capacitor at an intermediate section of the coil portion 43-1. Therefore, in some embodiments, at least a portion of the liquid crystal layer 45 is disposed between the intermediate section 43-1-1 of the coil portion 43-1 and the first electrode 44. It will be noted that the intermediate section 43-1-1 of the coil portion 43-1 refers to an intermediate portion of the coil portion 43-1 that is equal in length from both ends of the coil portion, for example, as shown in FIG. 4A. The intermediate section 43-1-1 of the coil portion 43-1 is a section of the coil portion 43-1 located in a preset range at both sides of a midpoint of the coil portion 43-1, wherein the midpoint is a point at half a length of the coil portion 43-1.

In some embodiments, since a width of the coplanar waveguide electrode is small, as shown in FIG. 4B, a width of the liquid crystal layer is larger than the width of the coplanar waveguide electrode.

In addition, referring to FIG. 4A, the feeding portion of the coplanar waveguide electrode includes a linear feeding portion 43-2, a first ground electrode 43-3, and a second ground electrode 43-4. The first ground electrode 43-3 and the second ground electrode 43-4 are respectively disposed at both sides of the linear feeding portion 43-2. Two ends of the coil portion 43-1 are respectively coupled to the first ground electrode 43-3 and the linear feeding portion 43-2. In some examples, the coil portion 43-1 and the linear feeding portion 43-2 are integrally formed.

An orthographic projection of at least a portion of the first electrode 44 on the second substrate 42, an orthographic projection of at least a portion of the intermediate section 43-1-1 of the coil portion 43-1 on the second substrate 42, and an orthographic projection of at least a portion of the liquid crystal layer 45 on the second substrate 42 completely overlap with each other. For example, referring to FIG. 4A, in some embodiments, the coil portion 43-1 is in the shape of a rectangular frame, the linear feeding portion 43-2 is in the shape of a strip, and both the first ground electrode 43-3 and the second ground electrode 43-4 are in the shape of a rectangular electrode plate.

In the coplanar waveguide feeding coil antenna, at least a portion of the liquid crystal layer is disposed between the intermediate section of the coil portion of the coplanar waveguide electrode and the first electrode to realize the function of a variable capacitor. Moreover, the second electrode is an existing coplanar waveguide electrode. Since an existing electrode of the antenna is used as the second electrode, the manufacturing process is further simplified and the production cost is further reduced.

Figure 5A:
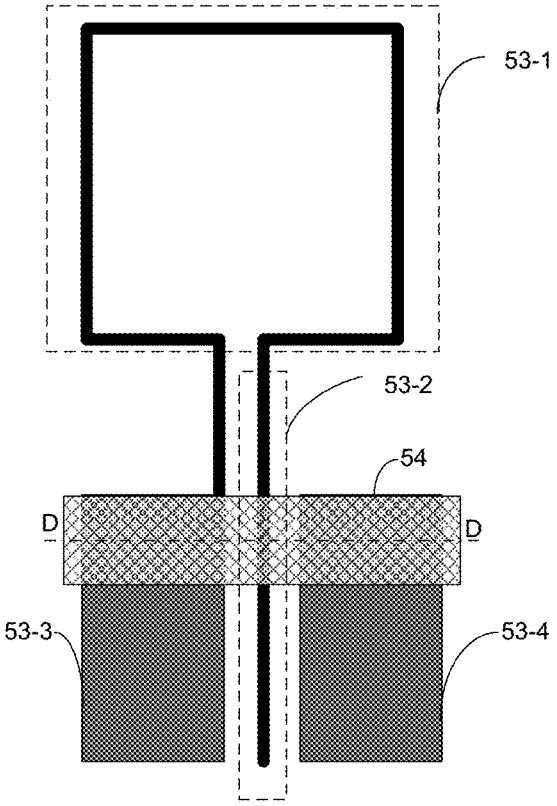
FIGS. 5A and 5B are schematic diagrams showing a structure of another coplanar waveguide feeding coil antenna, in accordance with some embodiments.
Figure 5B:
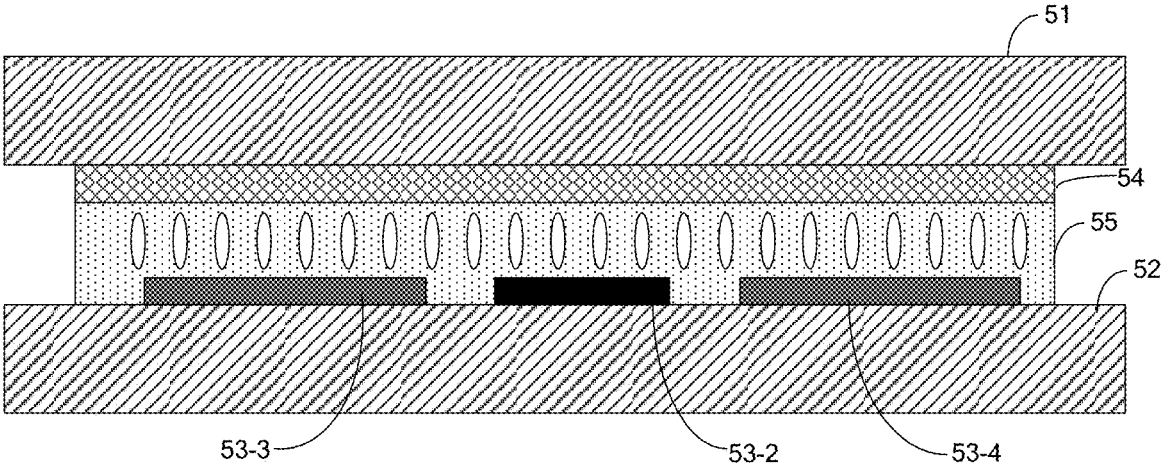

In some embodiments, the frequency tunable antenna is another frequency tunable antenna in the form of a coplanar waveguide feeding coil antenna, as shown in FIGS. 5A and 5B. FIG. 5A is a top view of the coplanar waveguide feeding coil antenna, and FIG. 5B is an enlarged cross-sectional view taken along line D-D in FIG. 5A. The coplanar waveguide feeding coil antenna includes a first substrate 51, a second substrate 52, a first electrode 54, a second electrode 53, and a liquid crystal layer 55. For example, the second electrode is a coplanar waveguide electrode.

The first substrate 51 and the second substrate 52 are disposed opposite to each other. The coplanar waveguide electrode is disposed on a side of the second substrate 52 close to the first substrate 51. The first electrode 54 is disposed on a side of the first substrate 51 close to the second substrate 52.

The coplanar waveguide electrode includes a linear feeding portion 53-2, a coil portion 53-1, a first ground electrode 53-3, and a second ground electrode 53-4. Two ends of the coil portion 53-1 are respectively coupled to the linear feeding portion 53-2 and the first ground electrode 53-3. The first ground electrode 53-3 and the second ground electrode 53-4 are respectively disposed at both sides of the linear feeding portion 53-2. In some examples, the coil portion 53-1 and the linear feeding portion 53-2 are integrally formed.

As shown in FIG. 5A, at least a portion of the liquid crystal layer 55 is disposed between a feeding portion of the coplanar waveguide electrode and the first electrode 54, and the feeding portion of the coplanar waveguide electrode includes the linear feeding portion 53-2, the first ground electrode 53-3, and the second ground electrode 53-4. At least a portion of the liquid crystal layer 55 is disposed between the linear feeding portion 53-2 and the first electrode 54, between the first ground electrode 53-3 and the first electrode 54, and between the second ground electrode 53-4 and the first electrode 54. In some examples, referring to FIG. 5B, another portion of the liquid crystal layer 55 is disposed in a space between the first electrode 54 and a gap portion between the linear feeding portion 53-2 and the first ground electrode 53-3, and in a space between the first electrode 54 and a gap portion between the linear feeding portion 53-2 and the second ground electrode 53-4.

For example, referring to FIG. 5A, in some embodiments, the coil portion 53-1 is in the shape of a rectangular frame, the linear feeding portion 53-2 is in the shape of a strip, and both the first ground electrode 53-3 and the second ground electrode 53-4 are in the shape of a rectangular electrode plate.

In the coplanar waveguide feeding coil antenna, at least a portion of the liquid crystal layer is disposed between the linear feeding portion and the first electrode, between the first ground electrode and the first electrode, and between the second ground electrode and the first electrode to realize the function of a variable capacitor. Moreover, the second electrode is an existing coplanar waveguide electrode. Since an existing electrode of the antenna is used as the second electrode, the manufacturing process is further simplified and the production cost is further reduced.

Figure 6A:
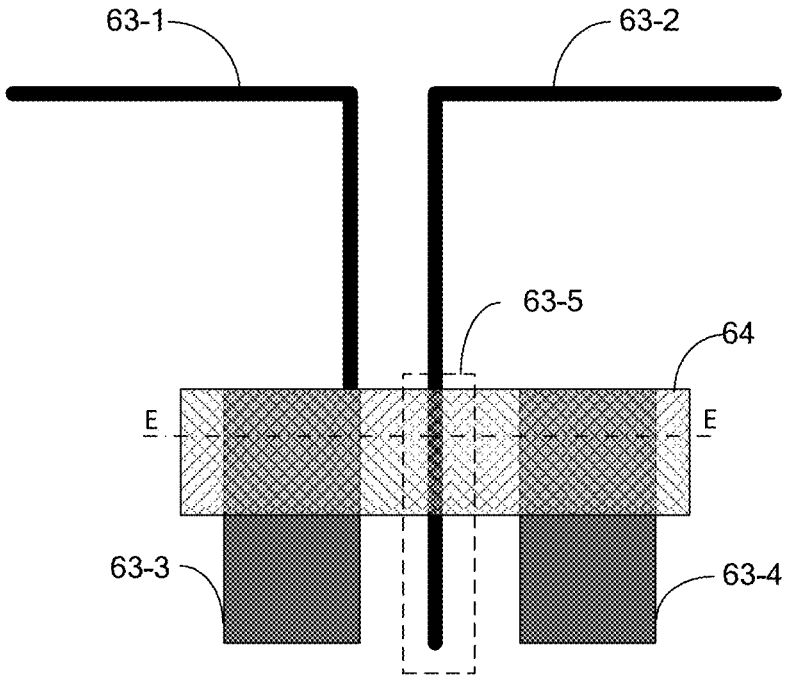
FIGS. 6A and 6B are schematic diagrams showing a structure of a coplanar waveguide feeding dipole antenna, in accordance with some embodiments.
Figure 6B:
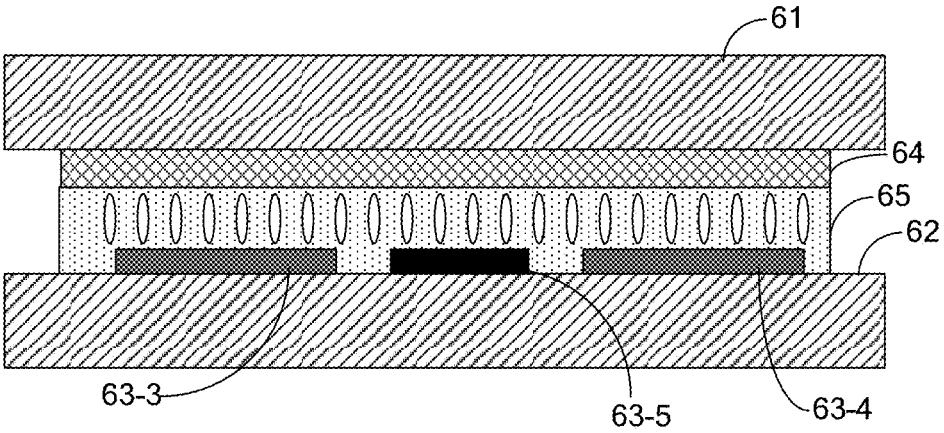

In some embodiments, the frequency tunable antenna is a frequency tunable antenna in the form of a coplanar waveguide feeding dipole antenna, as shown in FIGS. 6A and 6B. FIG. 6A is a top view of the coplanar waveguide feeding dipole antenna, and FIG. 6B is an enlarged cross-sectional view taken along line E-E in FIG. 6A. The coplanar waveguide feeding dipole antenna includes a first substrate 61, a second substrate 62, a first electrode 64, a second electrode, and a liquid crystal layer 65. For example, the second electrode is a coplanar waveguide electrode.

The first substrate 61 and the second substrate 62 are disposed opposite to each other. The coplanar waveguide electrode is disposed on a side of the second substrate 62 close to the first substrate 61. The first electrode 64 is disposed on a side of the first substrate 61 close to the second substrate 62.

The coplanar waveguide electrode includes a feeding portion and a dipole antenna portion. The dipole antenna portion includes a first sub-antenna electrode 63-1 and a second sub-antenna electrode 63-2. The feeding portion of the coplanar waveguide electrode 63 includes a first ground electrode 63-3, a second ground electrode 63-4, and a sub-feeding portion 63-5 coupled to the second sub-antenna electrode 63-2. In some examples, the second sub-antenna electrode 63-2 and the sub-feeding portion 63-5 are integrally formed.

The first sub-antenna electrode 63-1 is coupled to the first ground electrode 63-3, and the first ground electrode 63-3 and the second ground electrode 63-4 are respectively disposed on both sides of the sub-feeding portion 63-5.

At least a portion of the liquid crystal layer 65 is disposed between the first ground electrode 63-3 and the first electrode 64, between the second ground electrode 63-4 and the first electrode 64, and between the sub-feeding portion 63-5 and the first electrode 64. In some examples, referring to FIG. 6B, another portion of the liquid crystal layer is disposed in a space between the first electrode 64 and a gap portion between the sub-feeding portion 63-5 and the first ground electrode 63-3, and in a space between the first electrode 54 and a gap portion between the sub-feeding portion 63-5 and the second ground electrode 63-4.

Referring to FIG. 6A, in some embodiments, the first sub-antenna electrode 63-1 and the second sub-antenna electrode 63-2 are both L-shaped, and each of the first sub-antenna electrode 63-1 and the second sub-antenna electrode 63-2 has two arms which corresponds to two arms of the L shape. One arm of the two arms of the second sub-antenna electrode 63-2 is coupled to the sub-feeding portion 63-5 disposed side by side with the first ground electrode 63-3 and the second ground electrode 63-4. The first ground electrode 63-3 and the second ground electrode 63-4 are both rectangular electrode plates.

In the coplanar waveguide feeding dipole antenna, at least a portion of the liquid crystal layer is disposed between the first ground electrode and the first electrode, between the second ground electrode and the first electrode, and between the sub-feeding portion and the first electrode to realize the function of a variable capacitor. Moreover, the second electrode is an existing coplanar waveguide electrode. Since an existing electrode of the antenna is used as the second electrode, the manufacturing process is further simplified and the production cost is further reduced.

Some embodiments of the present disclosure provide a display panel 100, which includes the frequency tunable antenna 1001 described above.

Figure 7:
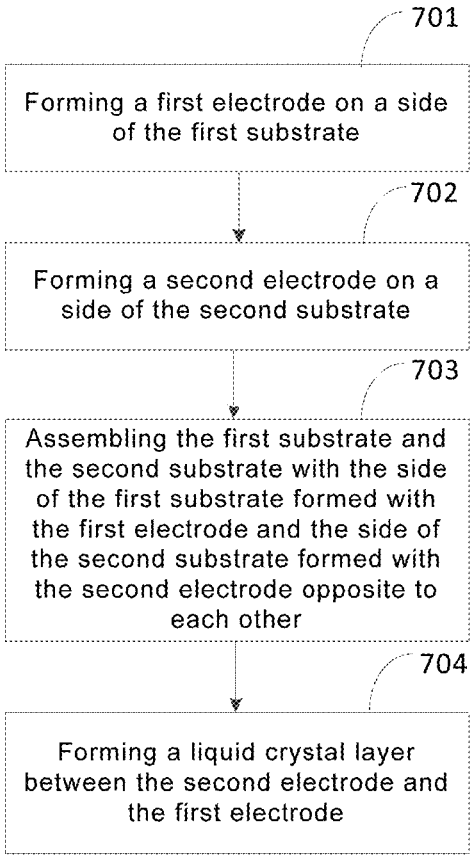
FIG. 7 is a flow chart of a method of manufacturing a frequency tunable antenna, in accordance with some embodiments.
Figure 8:
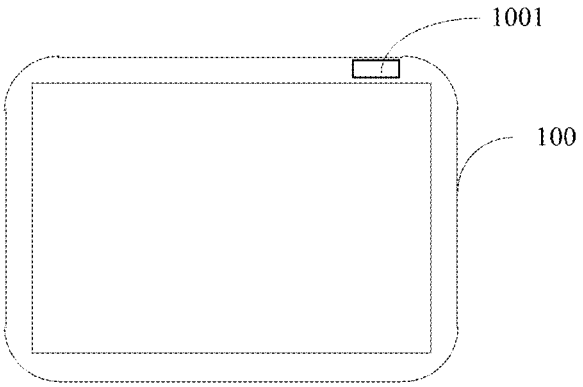
FIG. 8 is a schematic diagram showing a structure of a display panel including a frequency tunable antenna, in accordance with some embodiments.

Some embodiments of the present disclosure provide a method of manufacturing the frequency tunable antenna discribed above, and as shown in FIG. 7, the method includes step 701 to step 704 (S701-S704):

S701, forming a first electrode on a side of the first substrate;

S702, forming a second electrode on a side of the second substrate;

S703, assembling the first substrate and the second substrate with the side of the first substrate formed with the first electrode and the side of the second substrate formed with the second electrode opposite to each other; and S704, forming a liquid crystal layer between the second electrode and the first electrode.

It will be noted that the current manufacturing process already meets the requirement to assemble the first substrate and the second substrate first, and then to form a liquid crystal layer between the first electrode and the second electrode. However, the method is not limited thereto, and the liquid crystal layer may be formed first, and the first substrate and the second substrate may be assembled later. The second electrode and the first electrode are used to adjust the frequency of the frequency tunable antenna by controlling the alignment manner of the liquid crystals of the liquid crystal layer.

The beneficial effects of the method of manufacturing a frequency tunable antenna and the display panel provided by some embodiments of the present disclosure are the same as those of the frequency tunable antenna described above, and details are not described herein again.

The foregoing descriptions are merely some exemplary implementation manners of the present disclosure, but the protection scope of the present disclosure is not limited thereto. Any person skilled in the art could readily conceive of changes or replacements within the technical scope of the present disclosure, which shall all be included in the protection scope of the present disclosure. Therefore, the protection scope of the present disclosure shall be subject to the protection scope of the claims.

What is claimed is:

1. A frequency tunable antenna, comprising:

a first substrate;

a second substrate disposed opposite to the first substrate;

a first electrode disposed on a side of the first substrate close to the second substrate;

a second electrode disposed on a side of the second substrate close to the first substrate; and a liquid crystal layer disposed between the second electrode and the first electrode, wherein at least a portion of the liquid crystal layer is disposed between the first electrode and an intermediate section of a coil portion of the second electrode;

the intermediate section of the coil portion is a section of the coil portion located in a preset range at both sides of a midpoint of the coil portion, wherein the midpoint is a point at half a length of the coil portion;

the second electrode and the first electrode are configured to adjust transmitting and receiving frequencies of the frequency tunable antenna by controlling an alignment manner of liquid crystals of the liquid crystal layer; and the frequency tunable antenna is a coplanar waveguide feeding coil antenna; an orthographic projection of at least a portion of the first electrode on the second substrate, an orthographic projection of at least a portion of the intermediate section of the coil portion on the second substrate, and an orthographic projection of at least a portion of the liquid crystal layer on the second substrate completely overlap with each other.

2. The frequency tunable antenna according to claim 1, wherein the second electrode is a coplanar waveguide electrode.

3. The frequency tunable antenna according to claim 1, wherein a frequency of a voltage across the second electrode and the first electrode is within a preset range of (0, 1000) Hz.

4. A display panel, comprising the frequency tunable antenna according to claim 1.

5. A method of manufacturing the frequency tunable antenna according to claim 1, the method comprising:

forming a first electrode on a side of the first substrate;

forming a second electrode on a side of the second substrate;

assembling the first substrate and the second substrate with the side of the first substrate formed with the first electrode and the side of the second substrate formed with the second electrode opposite to each other; and forming a liquid crystal layer between the second electrode and the first electrode, wherein at least a portion of the liquid crystal layer is disposed between the first electrode and an intermediate section of a coil portion of the second electrode;

the intermediate section of the coil portion is a section of the coil portion located in a preset range at both sides of a midpoint of the coil portion, wherein the midpoint is a point at half a length of the coil portion;

the second electrode and the first electrode are configured to adjust transmitting and receiving frequencies of the frequency tunable antenna by controlling an alignment manner of liquid crystals of the liquid crystal layer; and the frequency tunable antenna is a coplanar waveguide feeding coil antenna; an orthographic projection of at least a portion of the first electrode on the second substrate, an orthographic projection of at least a portion of the intermediate section of the coil portion on the second substrate, and an orthographic projection of at least a portion of the liquid crystal layer on the second substrate completely overlap with each other.

6. A frequency tunable antenna, comprising:

a first substrate;

a second substrate disposed opposite to the first substrate;

a first electrode disposed on a side of the first substrate close to the second substrate;

a second electrode disposed on a side of the second substrate close to the first substrate; and a liquid crystal layer disposed between the second electrode and the first electrode, wherein the second electrode is a microstrip;

the frequency tunable antenna is a slot coupled patch antenna, and the first electrode is a ground electrode;

the slot coupled patch antenna further comprises a patch electrode disposed on a side of the first substrate away from the second substrate; the ground electrode includes a coupling slot, and an orthographic projection of the coupling slot on the second substrate is located within an orthographic projection of the patch electrode on the second substrate;

a portion of the microstrip is a feeding portion, and at least a portion of the liquid crystal layer is disposed between the ground electrode and the feeding portion of the microstrip; an orthographic projection of at least a portion of the feeding portion of the microstrip on the second substrate, an orthographic projection of at least a portion of the liquid crystal layer on the second substrate, and an orthographic projection of at least a portion of the ground electrode on the second substrate completely overlap with each other; and the orthographic projection of the coupling slot on the second substrate and the orthographic projection of the liquid crystal layer on the second substrate do not overlap;

the second electrode and the first electrode are configured to adjust transmitting and receiving frequencies of the frequency tunable antenna by controlling an alignment manner of liquid crystals of the liquid crystal layer.

7. The frequency tunable antenna according to claim 6, wherein a frequency of a voltage across the second electrode and the first electrode is within a preset range of (0, 1000) Hz.

8. A display panel, comprising the frequency tunable antenna according to claim 6.

9. A method of manufacturing the frequency tunable antenna according to claim 6, the method comprising:

forming a first electrode on a side of the first substrate;

forming a second electrode on a side of the second substrate;

assembling the first substrate and the second substrate with the side of the first substrate formed with the first electrode and the side of the second substrate formed with the second electrode opposite to each other; and forming a liquid crystal layer between the second electrode and the first electrode, wherein the second electrode is a microstrip;

the frequency tunable antenna is a slot coupled patch antenna, and the first electrode is a ground electrode;

the slot coupled patch antenna further comprises a patch electrode disposed on a side of the first substrate away from the second substrate; the ground electrode includes a coupling slot, and an orthographic projection of the coupling slot on the second substrate is located within an orthographic projection of the patch electrode on the second substrate;

a portion of the microstrip is a feeding portion, and at least a portion of the liquid crystal layer is disposed between the ground electrode and the feeding portion of the microstrip; an orthographic projection of at least a portion of the feeding portion of the microstrip on the second substrate, an orthographic projection of at least a portion of the liquid crystal layer on the second substrate, and an orthographic projection of at least a portion of the ground electrode on the second substrate completely overlap with each other; and the orthographic projection of the coupling slot on the second substrate and the orthographic projection of the liquid crystal layer on the second substrate do not overlap;

the second electrode and the first electrode are configured to adjust transmitting and receiving frequencies of the frequency tunable antenna by controlling an alignment manner of liquid crystals of the liquid crystal layer.

* * * * *